United States Patent [19]

Uchida et al.

[11] Patent Number: 4,911,372

[45] Date of Patent: Mar. 27, 1990

[54] YARN JOINING CONTROLLING METHOD FOR AUTOMATIC WINDER

[75] Inventors: Hiroshi Uchida, Oumihachiman; Toshio Yamauchi, Kyoto; Tadashi Suzuki, Uji, all of Japan

[73] Assignee: Murata Kikai Kabushiki Kaisha, Kyoto, Japan

[21] Appl. No.: 217,839

[22] Filed: Jul. 12, 1988

[30] Foreign Application Priority Data

Jul. 21, 1987 [JP] Japan ..... 62-181932

[51] Int. Cl.[4] ..... B65H 54/22

[52] U.S. Cl. ..... 242/35.6 R; 57/22

[58] Field of Search ..... 242/35.6 R, 35.5 R, 242/35.5 A, 36; 57/22; 289/1.5, 2

[56] References Cited

U.S. PATENT DOCUMENTS

| | | | |
|---|---|---|---|
| 3,458,912 | 8/1969 | Werffeli | 242/35.6 R X |
| 3,599,886 | 8/1971 | Koller | 242/35.6 R X |
| 3,776,479 | 12/1973 | Lutovsky et al. | 242/35.6 R |
| 3,918,651 | 11/1975 | Uchida | 242/35.6 R |
| 4,432,197 | 2/1984 | Ueda et al. | 57/22 X |
| 4,535,945 | 8/1985 | Rohner et al. | 242/35.6 R |
| 4,773,606 | 9/1988 | Ohashi | 242/35.6 R |

*Primary Examiner*—Stanley N. Gilreath

*Attorney, Agent, or Firm*—Spensley Horn Jubas & Lubitz

[57] ABSTRACT

In an automatic winder, presence or absence of a yarn on a package side and a yarn on a yarn supply bobbin side is detected during one cycle of yarn joining operation of a winding unit, and the winding unit after completion of a yarn joining operation is selectively instructed that an indication that yarn joining is impossible is to be made or that yarn joining is to be waited for.

12 Claims, 5 Drawing Sheets

YARN JOINING CONTROLLING METHOD FOR AUTOMATIC WINDER

Field of the Invention and Related Art Statement

This invention relates to a yarn joining controlling method for an automatic winder.

As automatic winders in which a plurality of winding units are provided in a juxtaposed relationship, various types are already known such as a type wherein a yarn joining device is provided for each of such winding units, another type wherein a working bogie truck having a yarn joining device thereon travels along such winding units, and a further type wherein such winding units individually make a circulating movement while a yarn joining device is disposed at a fixed location.

In such automatic winders as described above, when a defective portion such as a slub is detected in a yarn being fed, the yarn is compulsorily cut and an upper yarn on the package side and a lower yarn on the yarn supply bobbin side are joined to each other in order to remove such a defective portion of the yarn.

If yarn joining is effected successively by such a yarn joining operation, normal winding is started again, but in case yarn joining fails after a preset number of yarn joining operations, it is judged that yarn joining is impossible on the winding unit and an indication that yarn joining is impossible is made on the winding unit while winding is stopped in order to wait for processing of an operator.

In the conventional arrangement described above, the indication that yarn joining is impossible is made when it is judged that yarn joining is impossible only from the fact that yarn joining has failed after repetition of a preset number of yarn joining operations, that is, from the fact that no yarn being fed is detected upon starting of a drum after a yarn joining operation.

Accordingly, in case a lack of supply of a yarn supply bobbin occurs, yarn joining becomes impossible and hence winding is stopped without fail. In this instance, even if a bobbin is supplied again, the stopped condition is still maintained until an operator becomes aware of the winding unit. This will deteriorate the working efficiency.

Object and Summary of the Invention

It is an object of the present invention to improve the working efficiency of an automatic winder by starting a yarn joining operation again when a yarn supply bobbin is supplied to the winding unit, in case that the yarn joining has failed because of absence of a yarn supply bobbin in the winding unit.

According to the present invention, presence or absence of a yarn on a package side and a yarn on a yarn supply bobbin side is detected during one cycle of yarn joining operation of a winding unit, and the winding unit after completion of a yarn joining operation is selectively instructed that an indication that yarn joining is impossible is to be made or that yarn joining is to be waited for.

In case yarn joining has failed because of absence of an upper yarn, a yarn on a package side, an indication that yarn joining is impossible is instructed, but in case yarn joining has failed because of absence of a lower yarn, a yarn on a yarn supply bobbin side, the winding unit is brought into a yarn joining waiting condition, and at a point of time when a yarn supply bobbin is supplied to the winding unit in the yarn joining waiting condition, a yarn joining operation is started again.

Detailed Description of Preferred Embodiments

An embodiment of the present invention will be described below with reference t the drawings.

Figure 3:
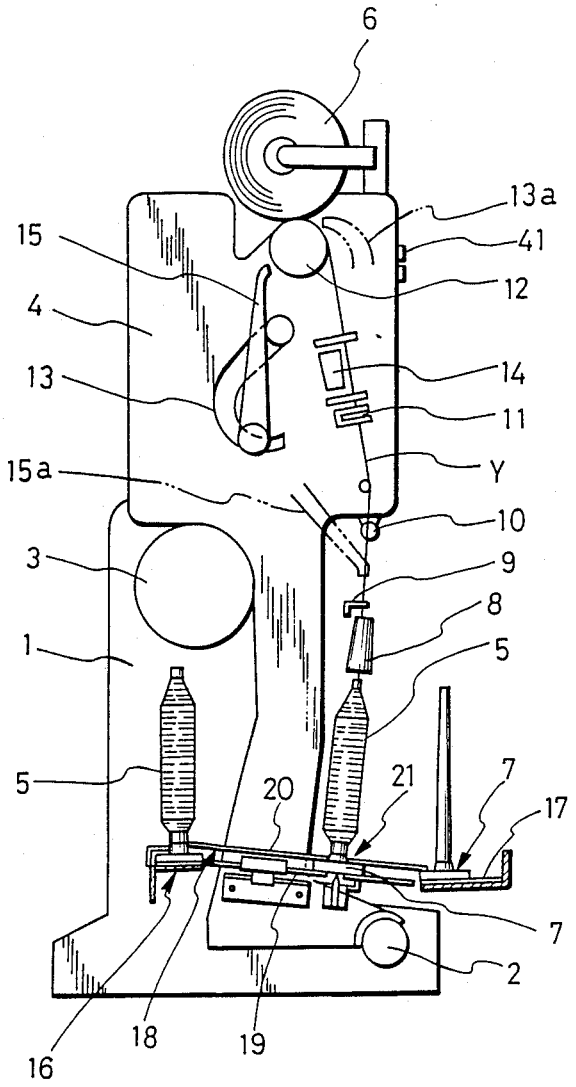
FIG. 3 is a side elevational view of general construction showing an example of winding unit.

FIG. 3 shows an example of a winding unit which is disclosed in U.S. Pat. No. 4,544,107. In particular, a support shaft 2 and a suction duct 3 are provided between a pair of side frames 1, and a winding unit 4 is supported for pivotal motion on the support shaft 2. During operation of an automatic winder, the unit 4 is placed also on the duct 3 so that it may be secured suitably.

In the winding unit, a yarn is wound from a yarn supply bobbin 5 onto a package 6. The yarn Y drawn out from the bobbin 5 on a tray 7 serving as a bobbin transport medium passes a balloon breaker 8 and a yarn guide 9 and then passes a tenser 10 at which a suitable tensile force is provided to the yarn Y whereafter the yarn Y passes a slub catcher 11 and is finally wound onto the package 6 which is rotated by a traverse drum 12.

Thereupon, if the slub catcher 11 detects a yarn defect in the yarn, a cutter built in the slub catcher 11 is rendered operative to compulsorily cut the yarn being fed and winding is stopped while a suction arm 13 is rendered operative to introduce an upper yarn on the package 6 side to a yarn joining device 14 and a suction arm 15 introduces a lower yarn on the bobbin 5 side to the yarn joining device 14 on which yarn joining is effected. If yarn joining is effected successfully, winding is started again. A large number of such winding units 4 as described above are disposed in a juxtaposed relationship in a row extending in a direction perpendicular to the plane of FIG. 3 to constitute a single automatic winder.

Further, a bobbin supplying conveyor belt 16 is installed on one side of the winding units 4 while another belt 17 for transporting empty bobbins or bobbins with remaining yarns discharged from the winding units is installed on the other side. A tray feeding path 18 is formed from a rotary disk 19, a guide plate 20 and so on between the conveyor belts 16 and 17, and a yarn is drawn out from a bobbin 5 positioned at a winding position 21.

Figure 4:
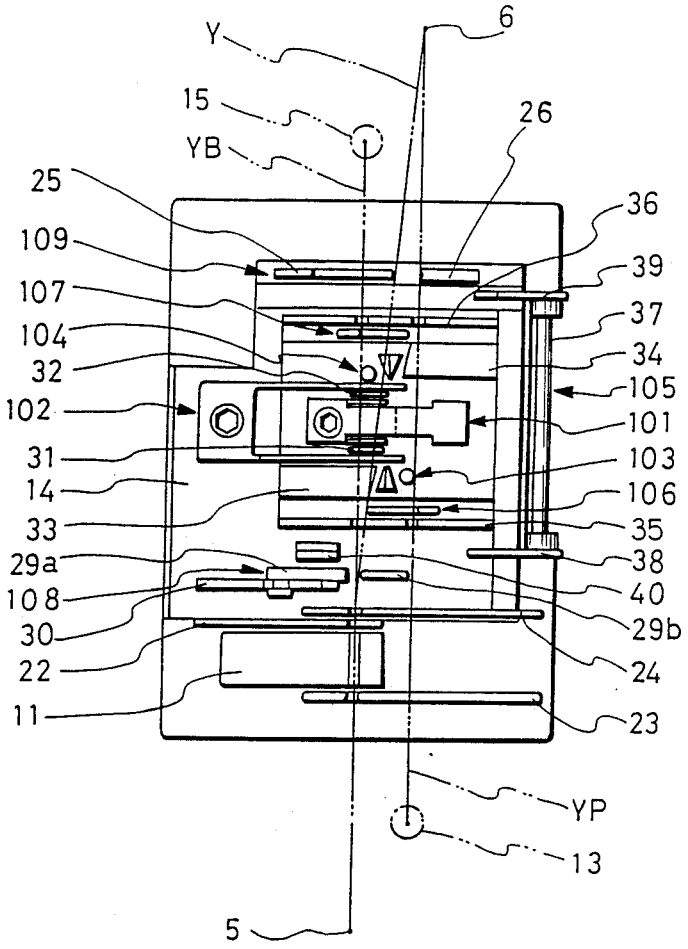
FIG. 4 is a front elevational view showing an example of pneumatic yarn splicing device.
Figure 6:
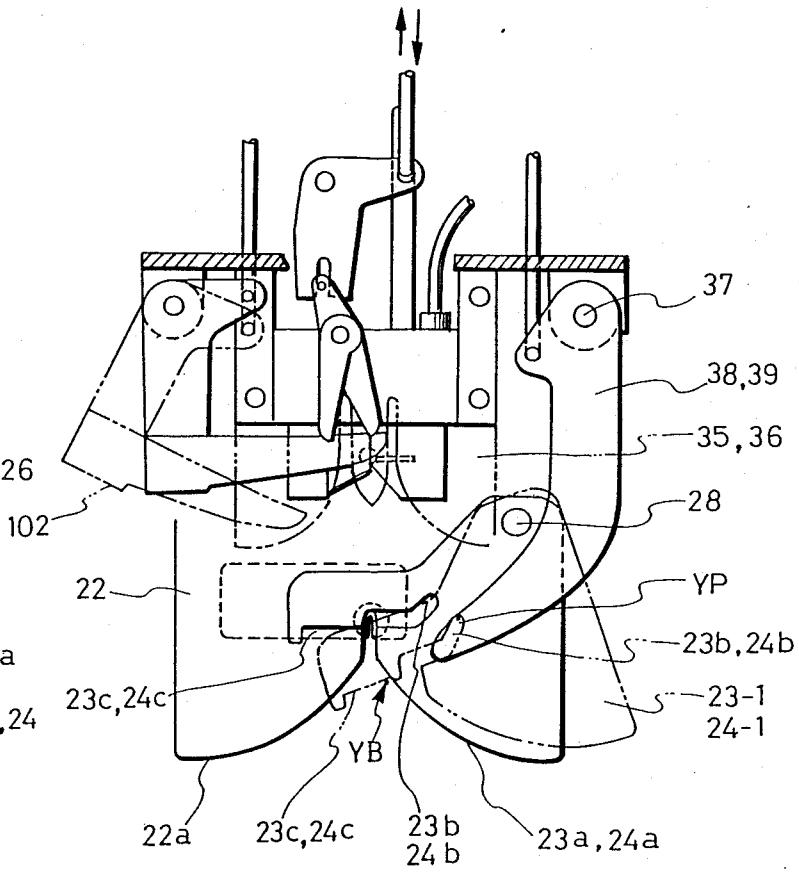
FIG. 6 is a plan view showing an operating condition of the same.
Figure 5:
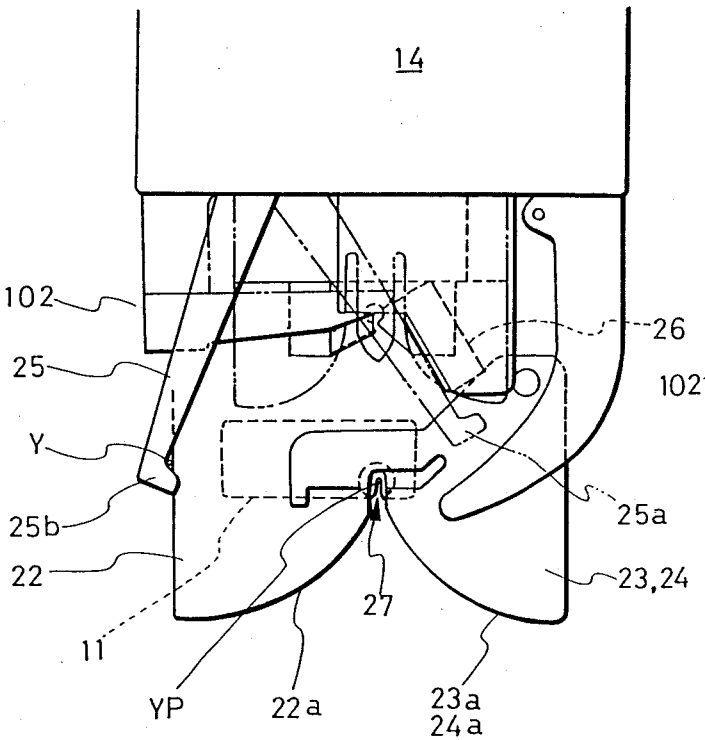
FIG. 5 is a plan view of the same.

As the yarn joining device 14 which is applied to such a winding unit as described above, a mechanical knotter or a pneumatic yarn splicing device which effects yarn splicing by an action of an air flow may be suitably employed. For example, FIGS. 4 to 6 show an example of pneumatic yarn splicing device. In particular, during normal rewinding, a yarn Y from a bobbin 5 takes such a route that it passes the detecting device 11, a fixed guide 22 provided at one end of the detecting device 11 and a pair of pivotal guides 23 and 24 mounted on the opposite sides of the detecting device 11 and then passes a location above the yarn joining device, that is, the yarn splicing device 14 and comes to the package 6.

The yarn splicing device 14 is composed basically of a yarn splicing member 101, a clamp device 102, a pair of controlling nozzles 103 and 104, a yarn putting aside lever 105, a pair of yarn cutting devices 106 and 107 and a pair of yarn supporting devices 108 and 109, add sucking openings at ends of the first and second suction arms 13 and 15 make turning movement above the yarn splicing device 14 such that they may suck yarn ends YB and YP on the bobbin 5 side and the package 6 side therein and move to and stop at locations outside the yarn splicing device 14.

It is to be noted that operations of the first and second suction arms 13 and 15 take place not at the same time but with a little time lag. In particular, at first the yarn end YP on the package side 6 is turned to a location outside the yarn splicing device 14 by the suction arm 13, and almost at the same time when the yarn end YP on the package side 6 is stopped the pivotal lever 25 of the yarn supporting device 109 on the package 6 side is pivoted in the counterclockwise direction as shown in FIG. 5 by a controlling cam not shown or the like to a chain line position 25*a* at which it is contacted with and stopped by a supporting block 26 secured at a fixed position. Thereupon, the yarn is caught and moved by a hook portion 25*b* of the pivotal lever 25 until it is clamped between the supporting block 26 and the pivotal lever 25.

In the meantime, while the pivotal lever 25 is operating, the yarn Y positioned on the fixed guide 22 and the pivotal guides 23 and 24 is fitted into a guide groove 27 along inclined faces 22*a*, 23*a* and 24*a* of the guides 22, 23 and 24, and confirmation of presence or absence of the yarn Y, confirmation whether or not two or more yarn ends YP are sucked in error by the suction arm 13 and so on are effected by the detecting device 11 provided at the same location as the guide groove 27. After confirmation of the yarn Y, the pivotal guides 23 and 24 are pivoted in the counterclockwise direction around a support shaft 28 as shown in FIG. 6 by a controlling cam or the like not shown so that the yarn end YP is removed from the detecting device 11 and fitted into escaping grooves 23*b* and 24*b* of the pivotal guides 23 and 24.

Further, almost a the same time with pivotal motion of the pivotal guides 23 and 24, the yarn end YB on the bobbin 5 side is sucked into the suction arm 15, and as the suction arm 15 is pivoted in the opposite direction to the suction arm 13, the yarn end YB is moved to and stopped at a location outside the yarn splicing device 14. Almost at the same time with such stopping of pivotal motion of the suction arm 15, a supporting plate 29*a* of the yarn supporting device 108 is moved in the same direction with the pivotal lever 25 along a guide plate 30 by a controlling cam or the like not shown together with the yarn Y until it is contacted with a supporting block 29*b* secured at a fixed position to clamp the yarn Y between the supporting plate 29*a* and the supporting block 29*b*. Thereupon, the yarn YB is caught by hook portions 23*c* and 24*c* near ends of the pivotal guides 23 and 24 by pivotal motion of the pivotal guides 23 and 24 as shown in FIG. 6, and checking at the detecting device 11 takes place after completion of yarn splicing.

The yarn splicing member 101 is provided substantially at the center of the yarn splicing device 14, and a pair of yarn guide pins 31 and 32, the clamping device 102, the controlling nozzles 103 and 104 and yarn guides 33 and 34, the yarn cutting devices 106 and 107, and a pair of fork guides 35 and 36 are disposed in this order on the opposite sides of the yarn splicing member 101. A yarn handling lever 105 is provided at a side portion of the yarn splicing member 101 and is composed of a support shaft 37 and a pair of levers 38 and 39 mounted for pivotal motion around the support shaft 37. After the detecting device 11 detects a slub or the like of the yarn Y and the yarn Y is cut and then the suction arms 13 and 15 operate to guide the yarn ends YP and YB to locations outside the yarn splicing device 14, the yarn handling lever 105 guides the yarn ends YP and YB in the direction toward the yarn splicing device 14. It is to be noted that the range of pivotal motion of the yarn handling lever 105 is defined by a stopper 40 which is provided between the fork guide 35 and the yarn supporting member 108 and formed substantially in V-shape in section such that the yarn putting aside lever 105 may be contacted with and stopped by the stopper 40. Accordingly, the range of pivotal motion of the yarn handling lever 105 can be adjusted by adjustment of the position of the stopper 40.

Yarn splicing control in the winder having such a yarn splicing device as described above will be described subsequently.

Figure 1:
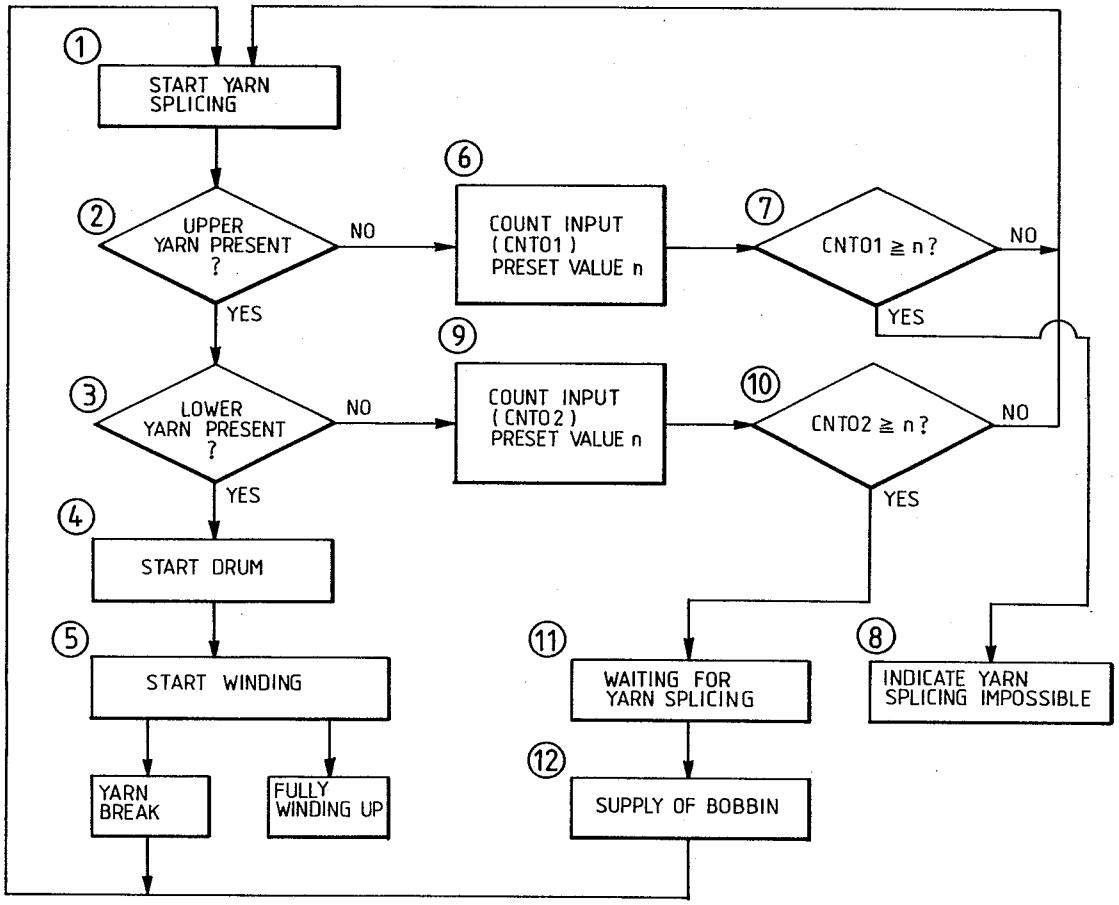
FIG. 1 is a flow chart showing an embodiment of a method of the present invention.

In FIG. 1, a flow chart of yarn splicing control is shown. In particular, if a break of a yarn takes place as described above and starting of yarn splicing (step 1) is started, detection of presence or absence of an upper yarn and a lower yarn (step 2) (step 3) are executed during one cycle of yarn splicing operation. In the case of the yarn splicing device described above, the step 2 is executed when the yarn YP is introduced into the slub catcher 11, and the step 3 is executed when the lower yarn is introduced into the slub catcher after yarn splicing.

If the upper yarn and the lower yarn are both present before the one cycle of yarn splicing operation is completed, then the traverse drum is started (step 4) after completion of the yarn splicing operation, and then if the yarn splicing is effected successfully, winding is started (step 5).

To the contrary, during such yarn splicing operation as described above, where there is no yarn upon detection of an upper yarn, that is, a yarn on the package side, a first counter CNT01 is incremented by one (step 6). The counter CNT01 has a preset value n stored therein, where the value n indicates a number of times of allowable failures in yarn splicing. Though a summing counter and a deducting counter may be used in the present invention, the summing counter is applied to the counters CNT01 and CNT02.

In particular, if it has been detected that a failure in yarn splicing due to absence of an upper yarn has been repeated by the n times (step 8), an instruction to make an indication that yarn splicing is impossible (step 8), and a yarn splicing operation is repeated no more but the winding unit is stopped to wait for processing by an operator. In particular, absence of a yarn on the package side means that a yarn is dropped to an end face of a package or an end of a yarn bites in a surface of a layer of the yarn so that it is impossible to drawn out the end of the yarn by means of the suction arm 13. Accordingly, also in this instance, automatic yarn splicing is impossible any more, and after readjustment by an operator, a yarn splicing operation is started again. It is to be noted that the means for making an indication that yarn splicing is impossible may be provided as a button 41 for indicating that yarn splicing is impossible which is called a yellow button which is projected forwardly when the winding unit is stopped in order to notify an operator.

On the other hand, in FIG. 1, if absence of a lower yarn is detected by the slub catcher 11 during a cycle of yarn splicing operation, a second counter CNT02 is incremented by one (step 9).

The second counter CNT02 also has a preset value n stored therein as a number of times of allowable continuous failures in yarn splicing similarly to the first counter. Accordingly, where the preset value n is, for example, n=3, if a yarn splicing operation fails by three times due to absence of a lower yarn, then the counter CNT02 present a value "+3" (step 10), and no yarn splicing operation is repeated any more. In this instance, however, only a yarn splicing waiting condition is entered (step 11) without making an indication that yarn splicing is impossible. In this condition, if a yarn supply bobbin is supplied to the winding unit after lapse of an arbitrary interval of time (step 12), a yarn splicing operation is started again in response to a detection signal of the supply of the bobbin.

It is to be noted that detection of the supply of the yarn supply bobbin may be made by a photoelectric tube sensor provided at a bobbin admitting port of each of the winding units for detecting admission of a bobbin or by a sensor provided at a bobbin incoming side end portion of the winder or else from a bobbin supply signal or the like when a yarn end finding processing operation of a yarn end finding device disposed for each of the winders is started.

Figure 2:
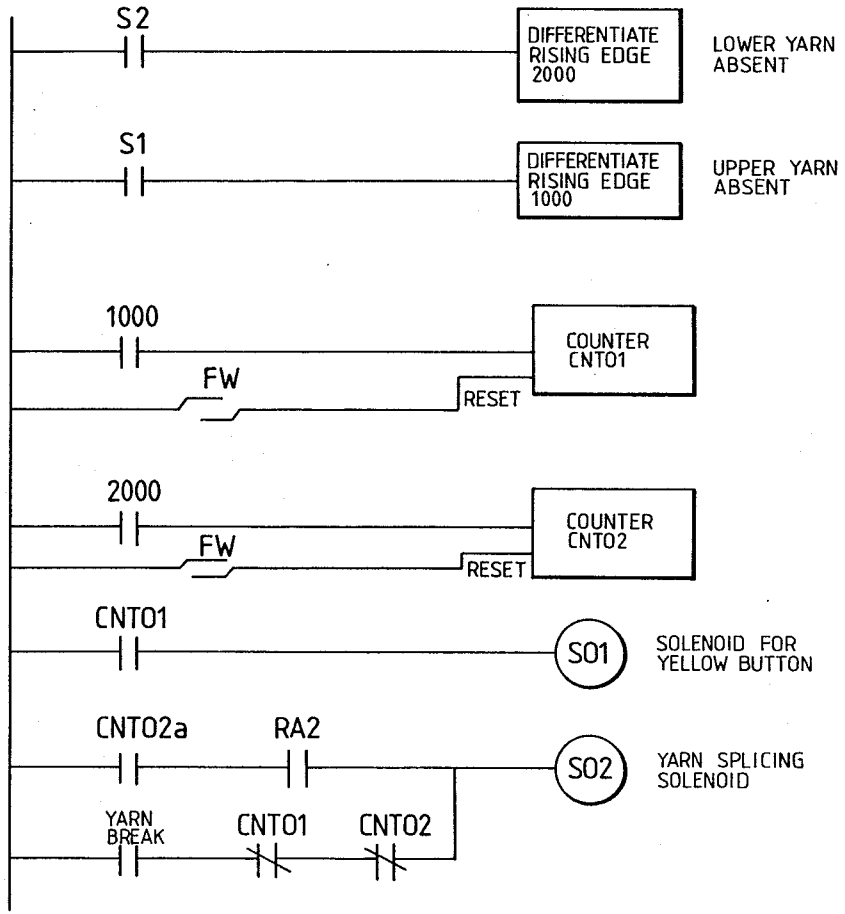
FIG. 2 is a view showing an example of sequencing circuit diagram of the same.

Such a yarn splicing waiting condition can be executed, for example, by means of a sequencing circuit shown in FIG. 2. In particular, if there is no lower yarn at a timing for detection of a lower yarn, the counter CNT02 is incremented by one, and if the preset value n is reached, counting of the counter CNT02 is stopped and a contact CNT02a is closed so that the yarn splicing waiting condition is entered. Then, when another contact RA2 is closed in response to a bobbin supply signal, a yarn splicing solenoid S02 is energized so that a yarn splicing operation is started.

It is to be noted that if the preset value is reached at the counter CNT01 which is provided for counting to detect absence of an upper yarn, a contact CNT01a is closed so that a solenoid S01 for the button for indication that yarn splicing is impossible is energized to project the yellow button 41 of FIG. 3 forwardly.

It is to be noted that the counters CNT01 and CNT02 are both reset by a yarn feeding signal FW.

As described so far, according to the present invention, the cause of a failure in yarn joining is detected whether it arises from a failure in drawing out of an upper yarn on the package side or from a failure in drawing out of a lower yarn on the yarn supply bobbin side, and in case a preset number of failures in yarn joining arising from a failure in detection of a lower yarn occur, a yarn splicing operation is waited for until a bobbin is supplied whereupon a yarn joining operation is performed automatically. Accordingly, compared with the conventional method, the working efficiency of the winding unit is improved, and useless checking operations can be avoided.

What is claimed is:

1. A yarn joining controlling method for an automatic winder, comprising the steps of:

detecting the presence or absence of a first yarn end from a package and a second yarn end from a bobbin during one cycle of a yarn joining operation of a winding unit, stopping the yarn joining operation upon detection of the absence of the first yarn end, and pausing the yarn joining operation upon detection of the absence of the second yarn end.

2. A yarn joining controlling method as claimed in claim 1, further comprising the steps of:

supplying a new bobbin to the winding unit upon detection of the absence of the second yarn end, detecting the supplying of the new bobbin and, restarting the winding unit upon detection of the supplying of the new bobbin.

3. A yarn joining controlling method for an automatic winder having a plurality of winding units, each of which includes a yarn joining member, a first yarn guide member for guiding a first yarn end from a package, a second yarn guide member for guiding a second yarn end from a yarn supply bobbin, a first detecting device for detecting a presence or absence of the first yarn end and the second yarn end, and a second detecting device for detecting a supply of a yarn supply bobbin to a winding unit, comprising the steps of:

detecting the presence or absence of the first yarn end and the second yarn end during one cycle of a yarn joining operation of a winding unit, stopping the yarn joining operation upon detection of the absence of the first yarn end, and pausing the yarn joining operation upon detection of the absence of the second yarn end.

4. A yarn joining controlling method as claimed in claim 3, further comprising the steps of:

supplying a new bobbin to the winding unit upon detection of the absence of the second yarn end, restarting the yarn joining operation upon supplying the new bobbin to the winding unit.

5. A yarn joining controlling method as claimed in claim 3, further comprising the steps of:

introducing the first yarn end into the first detecting device, detecting the presence of the first yarn end, setting the first yarn end in the yarn joining member, guiding the second yarn end into the yarn joining member, joining the first and second yarns to each other, and detecting the presence of the second yarn end.

6. A method for controlling an automatic winder including a drive means for driving yarn, and a yarn joining means for joining a first yarn end from a package to a second yarn end from a bobbin, the method comprising the steps of:

pausing the drive means;

detecting whether the first yarn end is present or is not present;

detecting whether the second yarn end is present or is not present; and joining the first yarn end to the second yarn end in response to detection of both the first yarn end being present and the second yarn end being present;

restarting the drive means in response to detection of both the first yarn end being present and the second yarn end being present.

7. A method for controlling an automatic winder, as claimed in claim 6, wherein the automatic winder includes an alarm indicator, further comprising the steps of:

stopping the yarn joining means in response to detection of the first yarn end being not present, and actuating the alarm indicator in response to detection of the first yarn end being not present.

8. A method for controlling a yarn joiner as claimed in claim 6, wherein the automatic winder includes an alarm indicator, further comprising the steps of:

pausing the yarn joining means in response to detection of the second yarn end being not present;

supplying a new bobbin to the winder; and restarting the yarn joining means upon supplying a new bobbin to the winder.

9. A method for controlling an automatic winder as claimed in claim 6, further comprising the steps of:

repeating the step of detecting whether the first yarn end is present or not present in response to detection of the first yarn end being not present;

counting a first number of the repetitions of the step of detecting whether the first yarn end is present or is not present;

generating a first signal when the first number of counted repetitions exceeds a predetermined value.

10. A method for controlling an automatic winder as claimed in claim 6, further comprising the steps of:

repeating the step of detecting whether the second yarn end is present or is not present, in response to detection of the second yarn end being not present;

counting a second number of the repetitions of the step of detecting whether the second yarn end is present or is not present, generating a second signal when the second number of counted repetitions exceeds a predetermined value.

11. A method for controlling an automatic winder, as claimed in claim 9, wherein the automatic winder includes an alarm indicator, further comprising the steps of:

stopping the yarn joining means in response to generating of the first signal, and actuating the alarm indicator in response to generation of the first signal.

12. A method for controlling an automatic winder, as claimed in claim 10, wherein the automatic winder includes an alarm indicator, further comprising the steps of:

pausing the yarn joining means in response to generation of the second signal;

supplying a new bobbin to the winder; and restarting the yarn joining means upon supplying the new bobbin to the winder.

* * * * *